United States Patent [19]

Fedele

[11] 3,962,736

[45] June 15, 1976

[54] DEVICE FOR MOVING OR POSITIONING A PATIENT IN A BED

[76] Inventor: Margaret T. Fedele, 828 Carmel Court, San Leandro, Calif. 94578

[22] Filed: June 25, 1975

[21] Appl. No.: 590,205

[52] U.S. Cl. ..... 5/81 R; 5/92

[51] Int. Cl.[2] ..... A61G 1/02

[58] Field of Search ..... 5/61, 81 R, 82, 92, 5/317

[56] References Cited

UNITED STATES PATENTS

| | | | |
|---|---|---|---|
| 3,810,263 | 5/1974 | Taylor et al. | 5/81 R |
| 3,829,914 | 8/1974 | Treat | 5/81 R |
| 3,849,813 | 11/1974 | Neilson | 5/81 R |
| 3,883,991 | 5/1975 | Adelhed | 5/81 R |

*Primary Examiner*—Casmir A. Nunberg
*Attorney, Agent, or Firm*—Warren, Chickering & Grunewald

[57] ABSTRACT

A device for moving a patient in a bed is disclosed and includes a base and movable platform mounted in superimposed relation to the base. The base provides a horizontally extending, substantially smooth and uninterrupted path over the top surface of the bed and bed linens. The platform is mounted to the base for low friction guided movement thereover, preferably by means of a track and rollers. The combined base and platform are preferably relatively thin in cross-section and formed with sloping edges so that the patient can be rolled onto the platform and moved by means of the platform by a single attendant. The movable platform is also preferably sloped to resist slipping of the patient and enhance movement of the platform over the base.

7 Claims, 4 Drawing Figures

DEVICE FOR MOVING OR POSITIONING A PATIENT IN A BED

BACKGROUND OF THE INVENTION

The widespread use of hospital beds having sections or segments which can be tilted or inclined for therapeutic reasons or to provide increased comfort to bedridden patients has also brought with it the problem of slipping or sliding of the patient in the bed as a result of the inclined section. Such beds are widely used in the home as well as at hospital. In most instances the head of the patient is somewhat elevated causing his upper body or trunk to tend to slip or slump toward the foot of the bed. This tendency can, of course, be reversed if his lower body is elevated. The need to elevate patients for therapeutic reasons is constant and reoccurring. Meals, medication and bed pans in addition to respiratory, drainage and other specific therapeutic problems require elevation of the bedridden patient several times during the average day. The gradual gravitation or slipping of the patient down the inclined section of the bed, however, may result in the patient becoming cramped and uncomfortable, nullifying the therapeutic or comfort effects sought to be achieved by inclining the patient.

Various devices and procedures have been evolved in order to enable an attendant to move or reposition a patient who has slipped or gradually moved down an inclined section of a bed. Most of these devices and procedures are adequate if two attendants are present to move the patient. Similarly, such prior devices and procedures are satisfactory if the patient can provide some assistance during the moving procedure. The problems arise, however, when a single attendant, often having less weight than the patient, must single-handedly move a seriously ill and virtually immobilized patient. This occurs not infrequently in the hospital and very often in home care situations. There is a current trend toward more professionalism in both institutional and home health care and yet the current patient moving techniques rely primarily on brute strength, i.e., dragging the patient across the bed linens.

A typical prior art patient moving or repositioning device is shown in U.S. Pat. No. 3,829,914 in which a laminated sheet-like device is disclosed. The side of the device to be placed upon the bed linens is formed with a low friction material while the other side of the device is formed of a relatively high friction material. The patient can then be rolled onto the laminated sheet and pulled over the bed linens with the low friction side slipping with respect to the bed linens. While under some conditions this patient moving device will function adequately, in many situations it presents drawbacks. The same sliding or slumping of the patient on an inclined surface tends to cause the bed linens and underlying bed pad to become rumpled and uneven. Similarly, the patient's own garments become rumpled and uneven. Additionally, the bed linens can become, and often are, somewhat moist or wet. The net result is that it can be most difficult for a single attendant to slide even a slippery surface over rumpled bed linens when the patient's full weight is pressing his own rumpled garments and the flexible sheet down against the bed linens.

Examples of other devices which have been employed to move a patient or support him in a bed, stretcher or the like are shown in U.S. Pat. Nos. 942,606; 998,996; 1,098,327; 2,766,463; 3,654,644; and 3,792,500. These devices, however, are either very complex and specialized in nature or provide only limited assistance in attempting to solve the problem of repositioning a patient in a bed.

Accordingly, it is an object of the present invention to provide a device for moving or positioning a patient in a bed which can be used by a single attendant to reposition a totally immobilized patient.

It is another object of the present invention to provide a patient repositioning device which can be used in the home as well as in an institution to provide increased professionalism in patient health care.

It is a further object of the present invention to provide a device for moving or repositioning a patient which is simple and easy to construct and yet enables movement of the patient without interference from the bed linens or patient's garments.

Still another object of the present invention is to provide a device for movement of a patient in a bed which is light in weight, easy to manipulate, strong and durable.

It is still a further object of the present invention to provide a device for moving or positioning a patient in a bed which provides trouble-free operation, requires little maintenance, can be operated by unskilled personnel, is highly sanitary, and is relatively inexpensive to construct.

The patient moving or positioning device of the present invention has other objects and features of advantage which will become apparent from and are set forth in more detail in the accompanying drawing and following description.

SUMMARY OF THE INVENTION

The device for moving or positioning a patient in a bed of the present invention is comprised, briefly, of a horizontally extending base formed to provide a substantially smooth and uninterrupted horizontally extending path over the top surface of the bed, and a horizontally extending platform mounted in superimposed relation to the base, the platform and base being cooperatively formed for low friction guided movement of the platform over the base along the horizontally extending path. The combined height of the platform and base and side construction thereof is preferably formed so that the patient may be easily rolled onto the platform and base from the side thereof prior to movement by means of the device. The platform may be sloped to resist sliding of the patient with respect to the platform, and is preferably mounted by roller elements to a pair of tracks formed in the base.

DESCRIPTION OF THE PREFERRED EMBODIMENT

Figure 1:
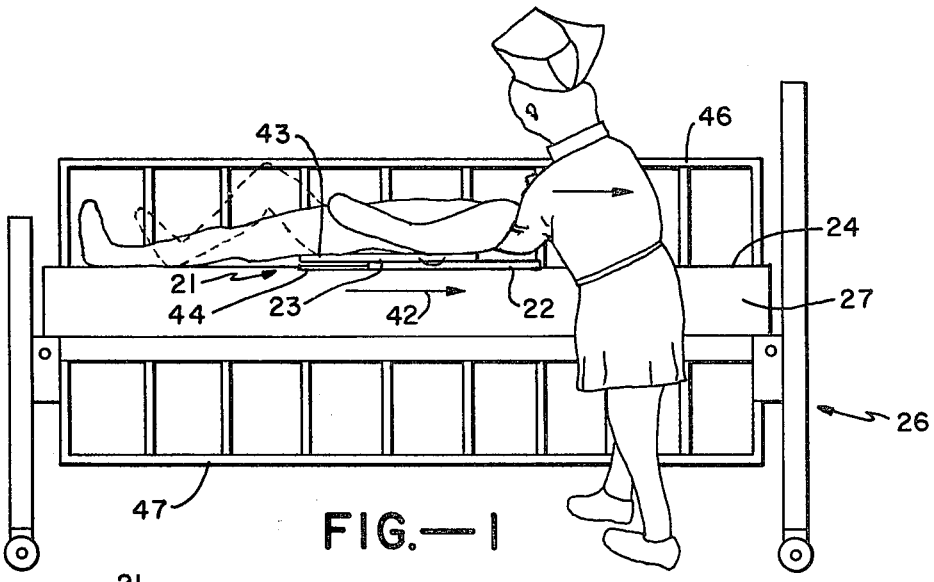
FIG. 1 is a side elevational view of a bed having a patient positioned on a patient moving device constructed in accordance with the present invention.

In order to provide a device which truly can be used by a single attendant to move a totally immobilized patient over rumpled bed linens and the like, the patient moving device of the present invention, generally designated 21, is comprised of a horizontally extending base 22 having a platform 23 superimposed thereover and movably mounted thereon. Base 22 is formed to provide a horizontally extending substantially smooth and uninterrupted path over the top surface 24 of bed 26 and any bed linens, pads, etc. which may be positioned on mattress 27.

Platform 23 and base 22 are cooperatively formed for relatively low friction guided movement of the platform over the base and along the path provided by the base. Thus, instead of attempting to slide the patient over the rumpled bed linens, the patient is placed upon the device of the present invention and base 22 affords a smooth and uninterrupted path over which movable platform 23 is then moved. A substantial portion of the patient's weight is supported on platform 23 so that a single attendant can move the patient unimpeded by bed linens or the like.

In order to provide for movement of platform 23 over base 22, it is preferable that at least one of the base and platform be formed with horizontally extending track means. This may be accomplished by forming base 22 with a pair of relatively spaced apart tracks 31 for receipt and guiding of roller elements 32 mounted to platform 23. Base 22 intermediate tracks 31 is preferably solid or closed by a sheet portion 33 so as to prevent the entry of bed linens up underneath the base in a manner which would interfere with the movement of platform 23. As will be understood, it would be possible for sheet portion 33 intermediate tracks 31 to be provided with some perforations and still be "solid" or "closed" within the meaning of the present invention since some openings would not permit bed linens to protrude upwardly and interfere with the movement of the platform.

As also will be understood, roller elements 32 can be formed in a number of different manners, including rollers which extend across a substantial transverse dimension of the base. Similarly, the roller elements can be carried by the base and the guiding track means provided in the platform. It should also be understood that low friction guides (not shown) can be substituted for roller elements 32. Thus, such guides and/or the track over which they slide can be formed of low friction plastic, such as teflon or the like.

In order to assist the attendant in moving the patient, it is further preferable that platform 22 be provided with handle means 35. As here shown, handle means 35 are formed as flexible straps affixed to platform 22 proximate the sides thereof. As will be understood, the patient can be rolled over straps 35 without any discomfort. Alternatively, finger receiving recesses can be provided to assist the attendant.

For ease of manipulation it is further preferable that the device of the present invention be formed so that the platform and base are held together as a single unit. Additionally, the device should be constructed so that the garments of the patient do not interfere with movement of the platform over the base. Both of these objects can be accomplished by providing tracks 31 with stop means 34 at each end thereof and with an upper lip or flange 36 protruding over roller elements 32. As an additional shield or protection, platform 23 is preferably provided with a flange 37 superimposed over flange 36. Thus, stops 34 limit the longitudinal or horizontal movement between the base and platform while flanges 36 on tracks 31 limit the vertical movement. The combination of flanges 36 and flanges 37 shield the roller elements and tracks from the entry of garments therebetween to be certain that the platform moves freely over base 22. Stop means 34 can optionally be removable to allow separation of the platform from the base for the purposes of cleaning or other maintenance.

Figure 3:
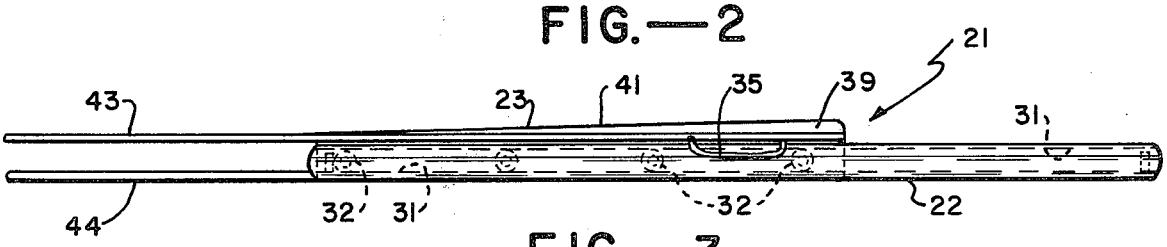
FIG. 3 is a side elevational view of the patient moving device shown in FIG. 2.
Figure 4:
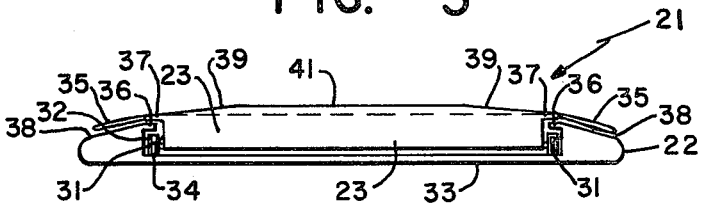
FIG. 4 is a front end elevational view of the patient moving device of FIG. 2.

As best may be seen in FIGS. 3 and 4, the device of the present invention is preferably relatively thin or low in height. Additionally, the side edges of base 22 can be formed with gradually sloped or tapered surfaces 38 to enable the patient to be gradually rolled up onto platform 23. The side edges of platform 23 can also be formed with tapered surfaces 39 to assist in rolling the patient onto the platform.

Figure 2:
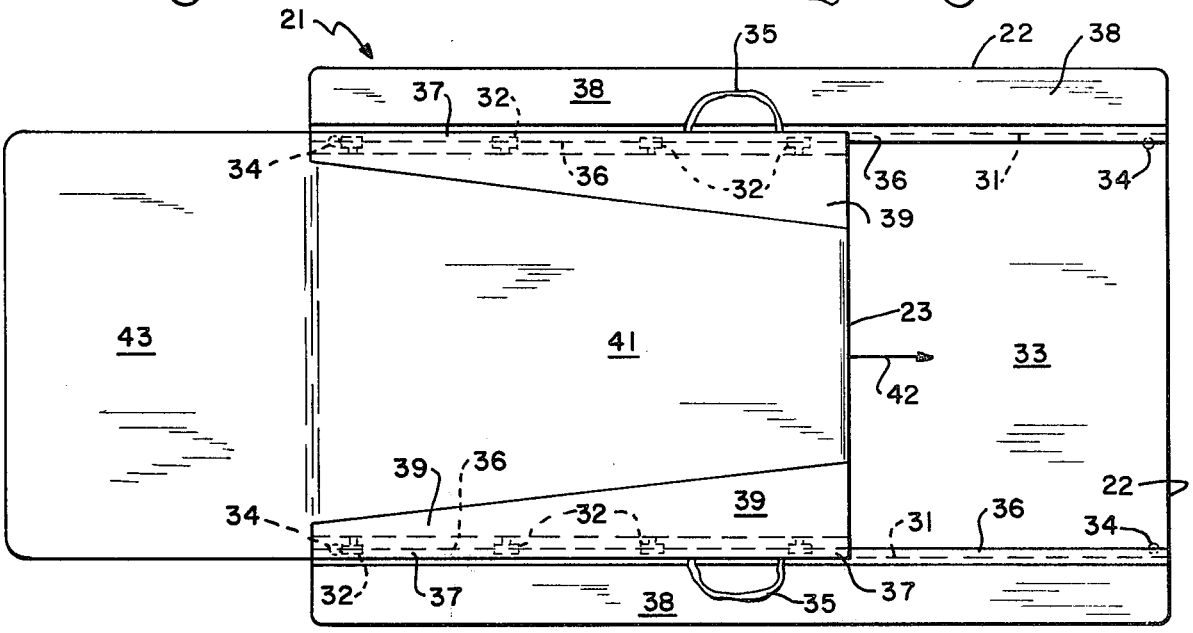
FIG. 2 is an enlarged top plan view of the patient moving device of FIG. 1.

As an additional feature of the present invention, platform 23 is preferably formed with an upwardly sloping or tapering surface 41 which slopes upwardly in the direction of arrows 42. This best may be seen in FIG. 2 where the slope is in the direction which will resist any tendency for the patient to slide with respect to the top surface of platform 23, instead of urging the platform over base 22.

The device of the present invention is preferably generally rectangular in shape with a width about equal to the width of the patient and a surface area of the platform sufficient to support at least the buttocks of the patient and preferably most of the back of the patient. The platform 23 is preferably formed with an extension portion 43 which supports the posterior and lower back of the patient. The buttocks can be supported on surface 41 with the attendant supporting the head and upper shoulders of the patient and thus reducing the need for extension portion 43. Extension portion 43 of the platform also prevents the patient and the patient's garments from being pulled up over the base as the platform is advanced along the base. To further prevent interference from bed linens, base 22 may be provided with a corresponding extension portion 44 subjacent and corresponding in shape to extension portion 43. If desired, roller elements or other intermediate support between extensions 43 and 44 can be provided. It will be noted and is a feature of the present invention that platform 23 is superimposed over a portion of base 22, including extension 44, throughout the full range of movement of the platform.

The preferred procedure for using the patient positioning device of the present invention can now be described in detail. First, the safety guard rail 46 on the side of the bed opposite to the attendant should be raised. The head of the bed should be lowered to a flat position as shown in FIG. 1. The safety guard rail 47 on the near side of the bed can be lowered. The patient is next rolled by the attendant until he is on his side with his face facing toward the far safety guard rail. The patient positioning or moving device 21 may now be placed immediately adjacent to the patient's back while he is on his side, with platform 23 in the position shown in FIGS. 1 through 3. The patient may now be rolled from his side on to his back and up the gradual incline 38 and 39 onto top surface 41 of the platform.

Once the patient is on the platform, he may be easily moved ahead by the device of the present invention. If the patient can cooperate with the attendant, it is preferable, although not absolutely necessary, to have the patient pull his knees to the upright position shown in dotted lines in FIG. 1. The attendant supports the patient's head, grasping the patient additionally under the armpits, and pulls the patient toward the head of the bed in the direction of arrow 42. This pulling action causes platform 41 to roll from the first position shown in FIGS. 1 through 3 to the right until roller elements 32 reach stops 34 at a second or moved position (not shown in the drawing). The patient may then be rolled off the device and onto his side again, and the patient moving device 21 removed from the bed. The patient is then rolled from his side to his back, the bed is elevated, and the near guard rail 47 raised. If it is desired to move the patient longitudinally in the bed a distance greater than the travel of platform 23 between stops 34, patient moving device 21 can simply be moved up in the bed when the patient is placed on his side and the platform reciprocated to its starting position. The patient can be rolled back onto the device for movement toward the head of the bed again. This operation can, of course, be repeated until the desired amount of longitudinal movement of the patient is achieved. It is preferable that the travel of platform 23 on base 22 be approximately one foot, which will allow the desired repositioning of most patients with one operation.

The patient moving device of the present invention can be formed of a number of different materials. It is highly desirable, however, that the weight of the device be as low as possible so as to aid in its manipulation and use. Thus, base and platform 32 can be formed of lightweight, high strength plastics, preferably a plastic with a bacteriostatic finish which will prevent the growth and multiplication of bacteria. Alternatively, the device can be formed from a lightweight, high strength metal, such as aluminum. The top surface 39 and 41 of platform 42 may optionally be padded or cushioned for the comfort of the patient. Such a pad or cushion, however, should be covered with a flexible plastic to facilitate cleaning with soap and/or alcohol. A single patient moving device could be used with removable and disposable pads having an absorbant top surface and an impermeable bottom surface to enable repositioning of several patients in a ward or the like while maintaining sanitary conditions. A second absorbant pad can be advantageously placed underneath the device to prevent moisture and bacteria from the bedding from contaminating the underside of the device. Alternatively, each patient in the ward can be provided with his personal low cost model which could be taken home with him at the end of his stay in the hospital much as thermometers and other devices currently are treated.

Top surface 41 may also be formed of a relatively high friction, yet cleanable, material, which will combine with the slope of top surface 41 in resisting sliding of the patient with respect to the platform. It is also preferable that the corners and edges of the device be rounded for patient safety.

What is claimed is:

1. A device for moving a patient in a bed comprising:

a horizontally extending base formed to provide a substantially smooth and uninterrupted horizontally extending path over the top surface of said bed; and a horizontally extending relatively rigid platform formed for support of a portion of said patient thereon and mounted in superimposed relation to a portion of said base, said platform and said base being cooperatively formed for low friction guided simultaneous reciprocation of all portions of said platform to and fro over said base along said horizontally extending path to enable movement of said patient by a single attendant unimpeded by bed linens or the like.

2. A device for moving a patient as defined in claim 1 wherein, said base is formed with a laterally downwardly sloping edge to facilitate rolling the patient onto said platform.

3. A device for moving a patient as defined in claim 1 wherein, said horizontally extending path is provided by track means formed in said base, and said track means and said platform are formed for movement of said platform from a first position to a horizontally displaced second position with said platform being superimposed over said base at all times during such movement.

4. A device for moving a patient as defined in claim 3 wherein, said track means is formed as a pair of spaced apart tracks proximate the sides of said base, said platform is provided with roller elements proximate the sides thereof dimensioned to roll in and mounted in said tracks, said tracks being formed with stop means proximate each end thereof to limit advancement of said platform; and at least one of said platform and said base being formed with shield means formed to prevent the entry of garments worn by said patient and bed linens to a position intermediate said roller elements and said tracks.

5. A device for moving a patient as defined in claim 1 wherein, at least a portion of said platform is upwardly sloping in the direction of movement along said horizontally extending path to resist any tendency for said patient to slide with respect to the top surface of said platform.

6. A device for moving a patient as defined in claim 1 wherein, said platform is generally rectangular having an area sufficient to support the buttocks of said patient, said platform further including an extension portion, said base having a corresponding extension portion formed to extend over and prevent the interference of bed linens with the movement of said platform, said extension portion of said base extending subjacent said extension portion on said platform when said platform is moved to a position enabling maximum movement of said patient along said horizontally extending path.

7. In a device for moving a patient in a bed including a horizontally extending base, and a horizontally extending platform formed for support of a portion of said patient thereon and mounted in superimposed relation to a portion of said base, at least one of said platform and said base being provided with horizontally extending track means formed for low friction guided movement of said platform over said base, and said base and said platform have a combined height and configuration enabling said patient to be rolled onto said platform from a side thereof, the improvement comprising:

said track means is formed as a pair of relatively spaced apart tracks in said base, said base being formed as a generally rectangular member elongated in the direction of said horizontally extending track means, said base further having a width dimension about equal to the width of said patient at the buttocks, said tracks being positioned in said base proximate the sides thereof, said base being substantially closed intermediate said tracks, and handle means secured to said platform and adapted for engagement by an attendant.

* * * * *